US005188047A

United States Patent [19]

Rohr et al.

[11] Patent Number: 5,188,047

[45] Date of Patent: Feb. 23, 1993

[54] PRODUCTION OF CIRCULAR SEAMS ON A WORKPIECE

[75] Inventors: Gunter Rohr, Hemmingen; Wolfgang Norz, Schwieberdingen, both of Fed. Rep. of Germany

[73] Assignee: Union Special GmbH, Stuttgart, Fed. Rep. of Germany

[21] Appl. No.: 469,661

[22] Filed: Jan. 24, 1990

[30] Foreign Application Priority Data

Jan. 27, 1989 [DE] Fed. Rep. of Germany ..... 3902333

[51] Int. Cl.[5] ..... D05B 19/00; D05B 81/00

[52] U.S. Cl. ..... 112/262.2; 112/121.11; 112/131; 112/272; 112/121.24

[58] Field of Search ..... 112/272, 275, 277, 131, 112/121.11, 121.26, 121.27, 121.24, 121.25, 315, 262.1, 262.2

[56] References Cited

U.S. PATENT DOCUMENTS

| | | | |
|---|---|---|---|
| 3,661,106 | 5/1972 | Huddelston | 112/121.27 X |
| 4,056,070 | 11/1977 | Hauf | 112/272 X |
| 4,104,976 | 8/1978 | Landau, Jr. et al. | 112/121.11 |
| 4,785,750 | 11/1988 | Best | 112/131 X |

OTHER PUBLICATIONS

Webster, *Webster's II New Riverside University Dictionary*, 1984, p. 264.

*Primary Examiner*—Peter Nerbun

*Attorney, Agent, or Firm*—Morgan & Finnegan

[57] ABSTRACT

For the production of circular seams with overlapped ends on a workpiece, a sewing machine driven in a controlled manner and provided with a marker for applying a mark, and a sensor for detecting the mark after marking the workpiece with a mark. The workpiece is sewn until the mark is effectively detected by the sensor which is disposed in a predetermined relationship to the marker, and thus initiates a control operation which initiates the end of the sewing operation in dependence upon a particular number of oversewn stitches. The mark may be applied and detected on the work material in one operating cycle. Thus, for example, circular workpiece openings may be sewn in such a way that the seam end is matched to the start of the seam in spite of different diameters of the work piece opening.

17 Claims, 5 Drawing Sheets

PRODUCTION OF CIRCULAR SEAMS ON A WORKPIECE

BACKGROUND OF THE INVENTION

The present invention relates to devices for producing circular seams on a workpiece using a sewing machine driven in a controlled manner. The present application claims the priority of Application No. P 39 02 333.8, filed in the Federal Republic of Germany on Jan. 27, 1989.

Markers in the form of marking tools which have electrically heated branding tools and pens which are displaceable against a spring are known from DE-OS 24 49 121, and are used for making collars in the production of shirts and blouses having attached collars and comprising a plurality of layers of material. The branding tools and the cartridges are lowered onto the collar, and as a result the attaching edge of the under-collar is provided with burnt-in marks and the edge of the over-collar is provided with colored marks which can be washed off. When the collar is sewn on, the marks are aligned by hand with the shoulder seams which end at the neck hole of the body part.

An automatically controlled sewing machine having a program-controlled working cycle is known from U.S. Pat. No. 4,038,931, in which a contactless proximity switch acts as a proximity sensor to produce an output signal in dependence upon irregularities in the workpiece. By way of this output signal, intervention is effected into the control program responsible for the automatic sequence of operations, which program controls the working cycles for the workpieces being sewn. In this device, irregularities in the workpiece include, for example, unintentional folds in the material, creases, and bunching. It is the aim of this device to detect unwanted faults during the sewing operation in order to prevent damage to the workpiece.

BACKGROUND OF THE INVENTION

A principal feature of the present invention is the provision of an improved method and a device for producing circular seams with overlapped ends.

The method of the present invention produces the overlapped ends of the seam on a workpiece using a sewing machine driven in a controlled manner, comprising the steps of applying a mark to the workpiece in the region of the seam, and sewing the workpiece until the mark is detected by a sensor.

Another feature of the invention is that the end of the seam of the workpiece is coordinated with the start of the seam in a manner to enable different diameters of the workpiece to be taken into account automatically.

Yet another feature of the invention is that the end of the sewing operation is initiated by the sensor in dependence upon a particular number of oversewn stitches.

Still another feature of the invention is that the circular seams may be produced on workpiece openings such as the neck and leg.

In accordance with the present invention, the sewing machine produces the circular seams with overlapped ends on a workpiece having a marker for applying a mark to the workpiece, and a sensor for sensing the mark.

A feature of the present invention is that the sewing machine has a controller for controlling the sewing machine such that the sewing operation is terminated by the sensor in dependence upon the number of oversewn stitches.

Another feature of the invention is that the sensor may be disposed in a predetermined spaced relationship to the marker such that the application and detection of the mark may take place in one operating cycle.

Still another feature of the invention is that the sewing machine may automatically sew, for example, circular neck and leg openings of different sizes on bathing costumes, in a simplified manner.

Yet another feature of the invention that once the mark has been effectively detected by the sensor, a control operation for driving the sewing machine is triggered during the sewing operation or during one operating cycle.

A feature of the invention is that the control operation initiates termination of the seam on the workpiece and matches it to the start of the seam.

Another feature of the invention is that the sewing machine is then stopped, the sewing threads are severed, and the workpiece is removed.

A feature of the invention is that in the case of a flat workpiece, the workpiece is also positioned independently of the number of sewn stitches on a location predetermined by means of the mark following detection of the mark by the sensor.

Another feature of the invention is that the marking agent can be sprayed onto the workpiece from a supply tank by means of a pump.

Still another feature of the invention is that the marking agent may be applied to the workpiece by a marker pen.

Yet another feature of the invention is that a proximity switch may be used as the sensor to detect the mark.

A feature of the invention is that the marking agent may comprise a vaporizable medium, for example water, since proximity switches which react capacitively respond to drops of water which subsequently dry out on the workpiece.

Another feature of the invention is that the marking agent may contain a luminophor and the sensor may be in the form of a luminescence detection.

A feature of the invention is that the luminophor or luminous agent may be invisible to the human eye.

Further features will become more fully apparent in the following description of the embodiments of this invention and from the appended claims.

DESCRIPTION OF THE PREFERRED EMBODIMENTS

Figure 1:
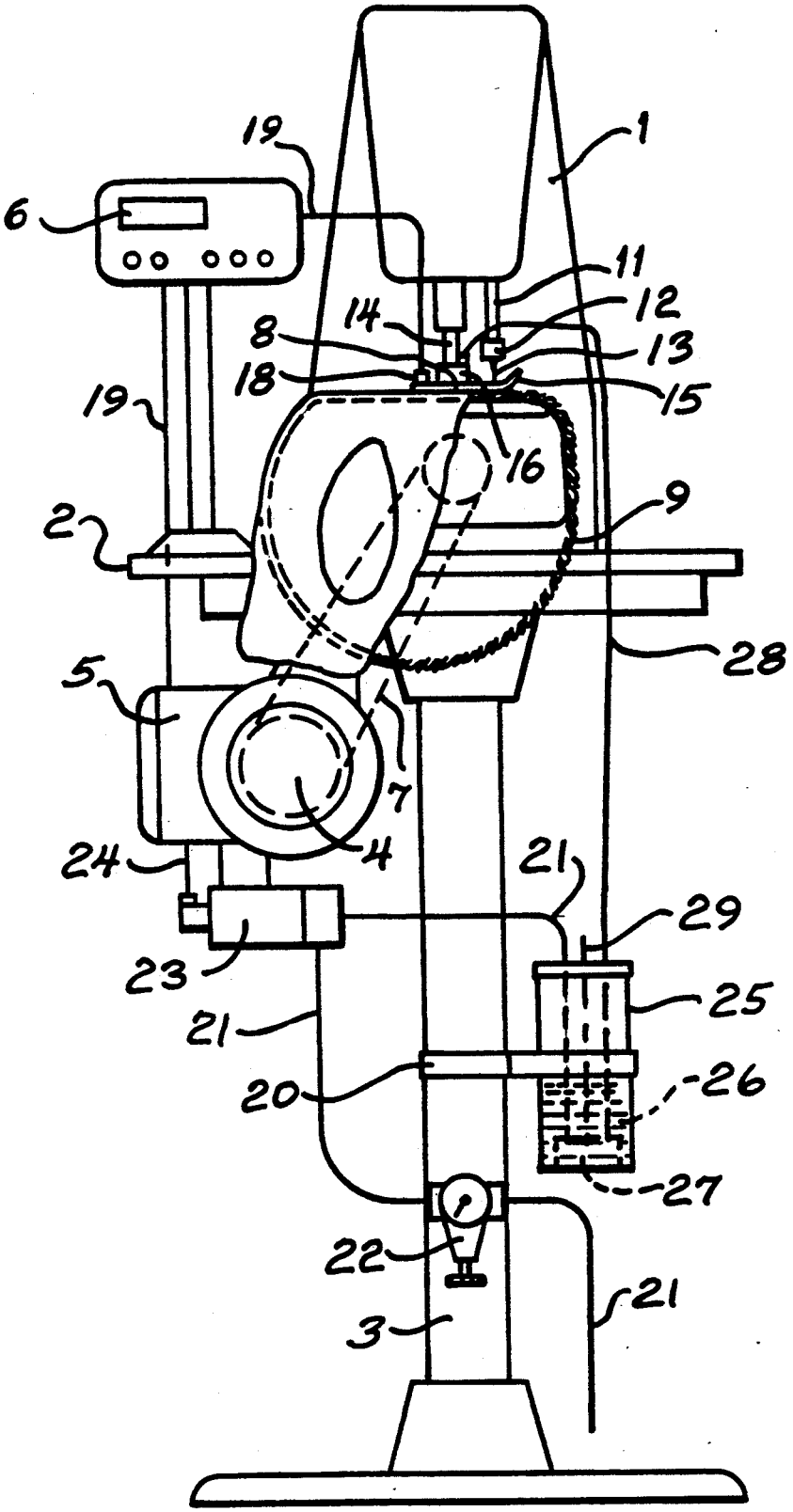
FIG. 1 is a side elevational view of a sewing machine for sewing circular workpiece openings in accordance with the present invention.

Referring now to FIG. 1, there is shown a sewing machine 1 mounted on table top 2 which is supported by a frame 3. The sewing machine has a motor drive and brake 4 having a control box 5 for controlling the working cycle for the sewing machine which is flange mounted onto the frame 3. The table top carries a control panel 6 for entering sewing-specific data, for example the operating speed, and for switching on the sewing machine which is driven by the motor drive 4 by means of a belt 7.

Figure 3:
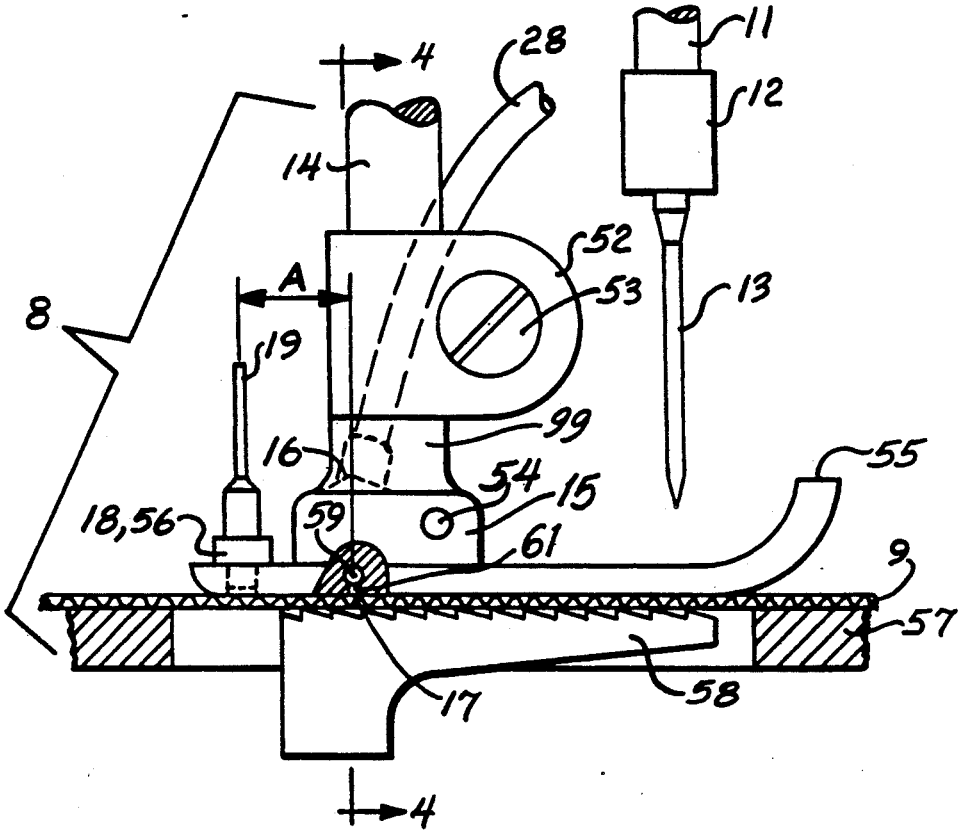
FIG. 3 is a fragmentary elevational view, taken partly in section, of a workpiece feed device in the sewing machine of FIG. 1.
Figure 4:
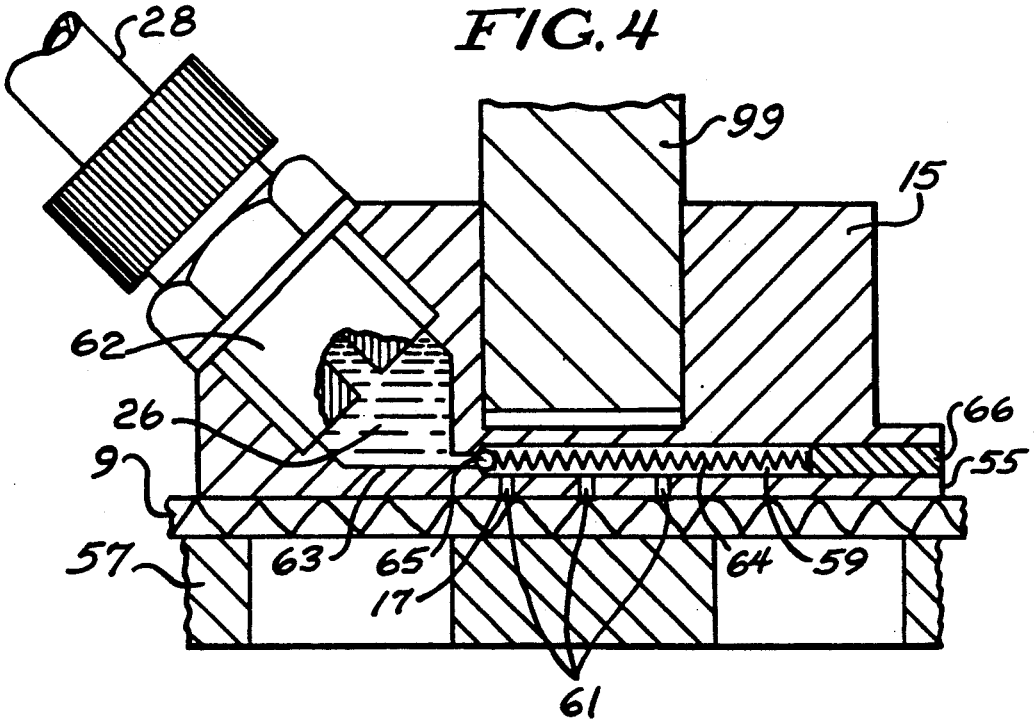
FIG. 4 is a sectional view taken substantially as indicated along the line 4—4 of FIG. 3.
Figure 5:
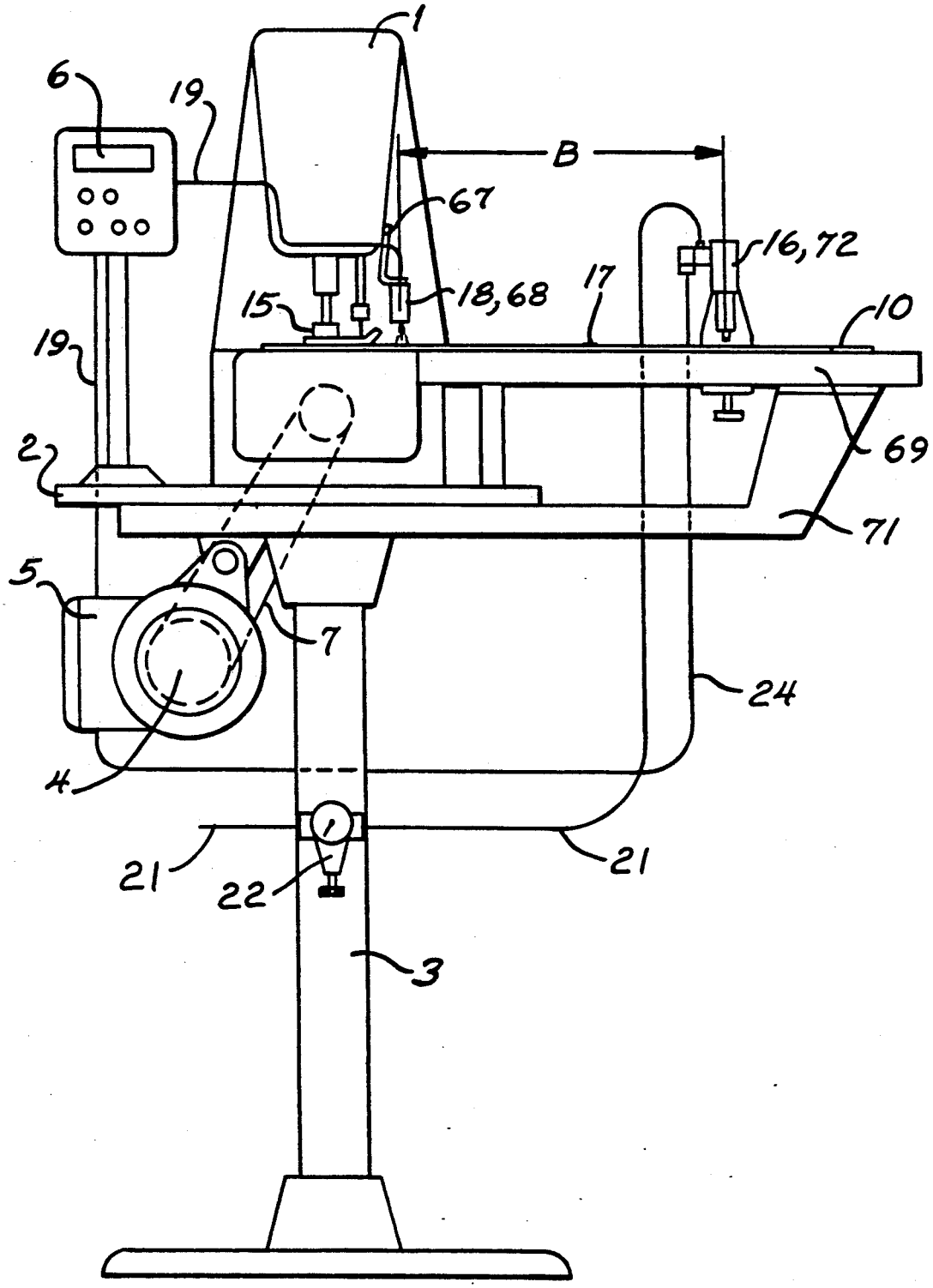
FIG. 5 is a side elevational view of another embodiment of the sewing machine of the present invention for sewing a flat workpiece.
Figure 6:
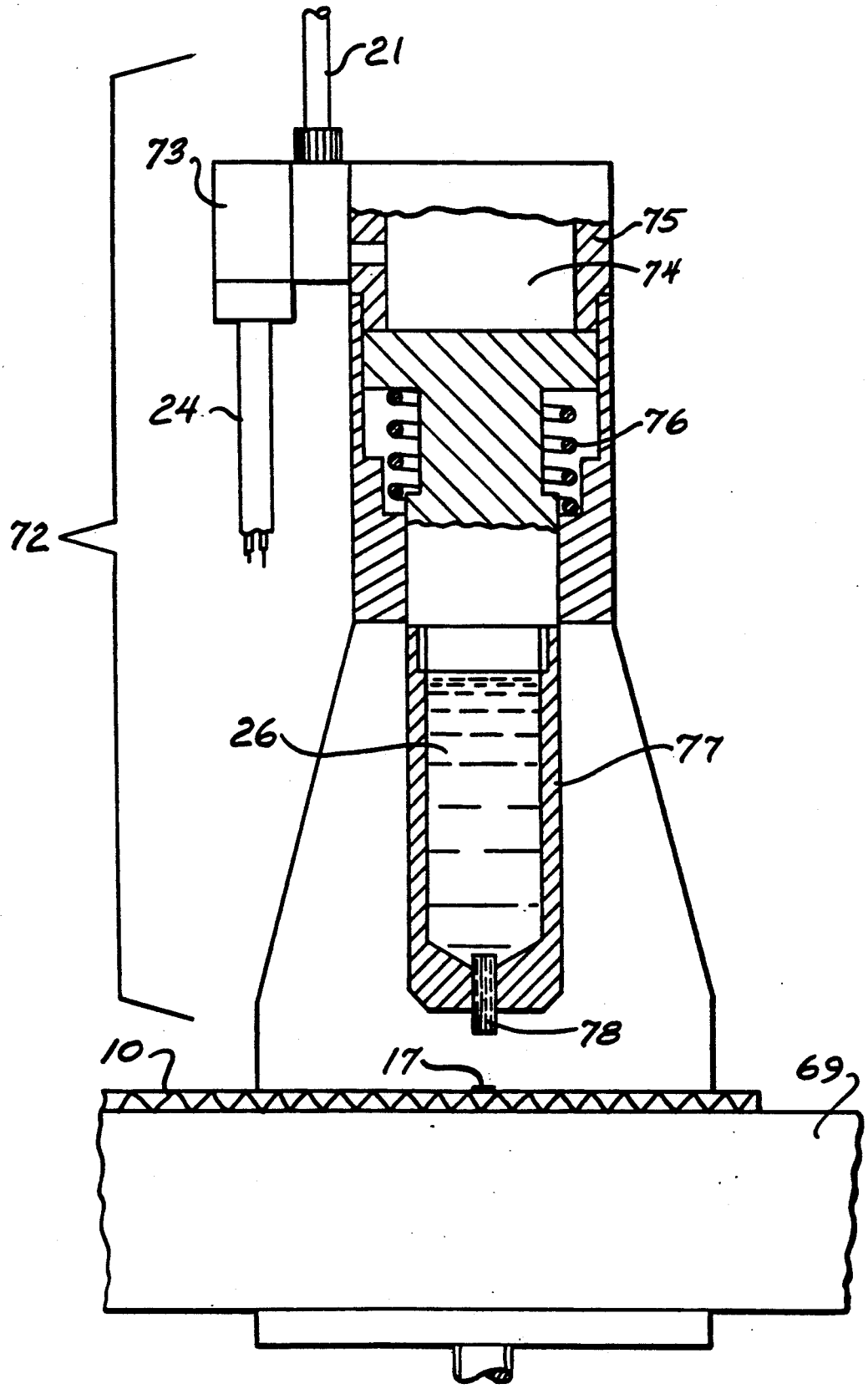
FIG. 6 is a fragmentary elevational view on an enlarged scale, taken partly in section, of a movable marker pen in the sewing machine of FIG. 5 in the form of a marker pen.

The sewing machine has a workpiece feed device 8 which conveys a circular workpiece 9, as shown in FIG. 1, or a flat workpiece 10, as shown in FIG. 5. The sewing machine has a needle bar 11 driven by a suitable device in a reciprocating manner, and a needle head 12 which carries a needle 13. The sewing machine 1 has a reciprocating presser bar 14 disposed next to the needle bar 11, and has a presser foot 15. As shown in FIGS. 3, 4, and 6, the presser foot 15 carries part of a marker 16 which applies a mark 17 to the workpiece 9 or 10. As shown in FIG. 3, the sewing machine 1 has a sensor 18 which is disposed in a predetermined relationship A relative to the marker 16. With reference to FIGS. 1 and 3, the sensor 18 is electrically connected by a control line 19 to the control box 5 through the control panel 6. The sensor 18 may also be disposed on the level of the marker such that there exists no spacing in the direction of sewing. As shown in FIG. 1, the sewing machine 1 has a compressed air line 21 connected to a pressure reducer 22 and a solenoid valve 23, with the valve 23 being secured to the control box 5, and with the valve 23 being actuated by the control box 5 through an electrical lead 24. The line 21 extends to a supply tank 25 which is secured to the frame 3 by a holder 20. The supply tank 25 and the marker retain a marker agent 26 which may comprise water. The marker has a pump 27 located in the supply tank 25, and the pump 27 supplies the marker agent 26 in a controlled manner through a line 28 and sprays it onto the workpiece. The sewing machine 1 has a exhaust air line 29 which ventilates the pump 27.

Figure 2:
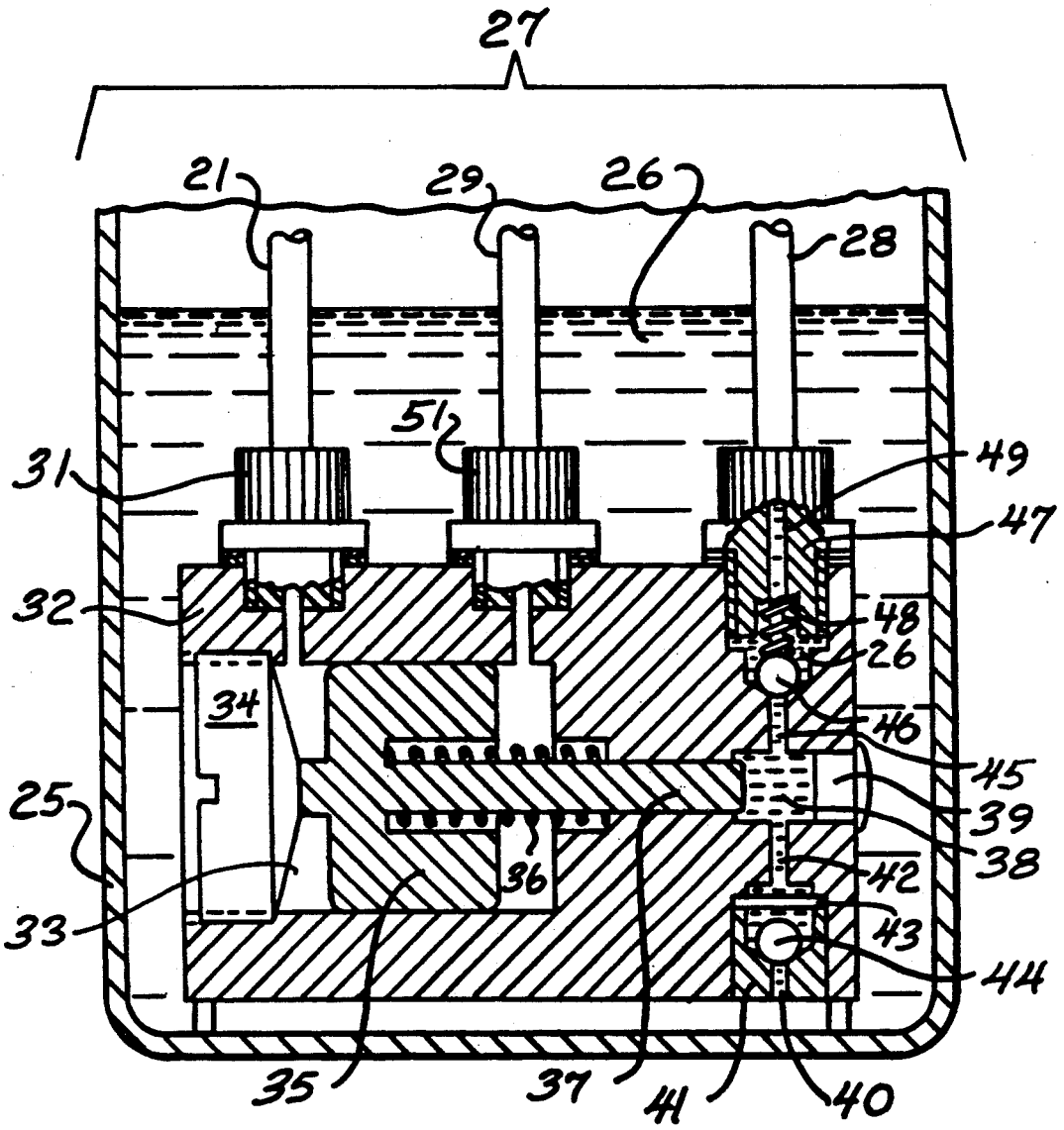
FIG. 2 is a fragmentary sectional view of a pump in a supply tank in the sewing machine of claim 1.

With reference to FIG. 2, the compressed air passes through the line 21 through a hollow union 31 to a pump member 32 and into a bore 33, with the bore 33 being closed by a screwed-in closure plug 34. The pump 27 has a plunger 35 slidably received in the bore 33, and urged by a compression spring 36 in its resting position against the plug 34. The plunger 35 has an elongated stem 37 guided in the pump member 32 such that it is in fluid tight relationship to the marking agent 26 in a pump chamber 38, with the chamber 38 being filled with the marking agent 26 and being closed by a plug 39.

The marking agent 26 passes from a chamber of the supply tank 25 through an opening 40 of a one-way valve member 41, and through an inlet bore 42 into the pump chamber 38. A transverse pin 43 retains a valve ball 44 in the valve member 41. The valve member 41 permits passage of fluid from the chamber of the supply tank to the pump chamber, but prevents passage of fluid from the pump chamber to the chamber of the supply tank. The pump 27 also has a one-way outlet valve comprising an outlet bore 45 communicating with the pump chamber 38, with the valve and bore being closed during a suction stroke by a compression spring 48 which biases a ball 46 against a seat surrounding the bore 45. The outlet valve permits passage of fluid from the pump chamber 38 through a bore 49 of a hollow union 47, and prevents passage of fluid from the bore 49 to the pump chamber 38. As the compressed air passes into the bore 33 of the pump 27, the plunger 35 is moved from a first position against the plug 34 to a second position toward the pump chamber 38 against the force of the spring 36, and the stem 37 moves into the pump chamber 38 and compresses the marker agent 26 in the pump chamber 38 in order to close the valve member 41, and open the outlet valve and permit passage of the marker agent through the bore 49 and the line 28 towards the workpiece 9. The exhaust air line 29 is connected to a hollow union 51 on the pump member 32. When the air pressure from line 21 is removed from the bore 33, the plunger 35 is biased by the spring 36 in order to open the valve member 41 and permit passage of fluid into the pump chamber 38, and close the outlet valve.

As shown in FIG. 3, the workpiece feed device 8 is surrounded by a slit hub 52 which secures connecting bar 99 to (see also FIG. 4 in the Proposed Amendment to the Drawings) to the presser bar 14 as screw 53 is tightened. A presser foot 15 is connected to the connecting bar 99 by a pin 54 in an articulated manner. The sensor 18, which comprises a capacitive proximity switch, is secured to a rear end of the foot 55 in a position to detect the mark 17 on the workpiece 9 in the region of the seam during feeding of the workpiece. The sewing machine 1 has a feed dog 58 projecting through a throat plate 57, with the feed dog 58 conveying the workpiece 9 in the workpiece feed direction. The marker 16 has a cross bore 59, and the marker agent flows in a controlled manner through the bore 59 in order to apply a mark 17 to the workpiece 9 through one or more nozzles 61 communicating with the bore 59.

As shown in FIG. 4, The presser foot 15 has a hollow union 62 which retains one end of the flexible line 28. The presser foot 15 has a chamber 63 filled with a marking agent, with a ball 65 being biased by a helical spring 64 in order to close the chamber 63, and prevent the marker fluid 26 from escaping into the cross bore 59 during the actual sewing operation. As shown, the cross bore 59 has one end closed by a pin 66.

As shown in FIG. 5, the sensor 18 comprises a luminescence detector 68 which is fastened by a holder 67 to the sewing machine 1. The marker 16 is adjustably secured at a reference distance B to a platform 69, with the platform 69 being connected to a holder 71 to the table top 2. The marker in this form may comprise a marker pen 72.

As shown in FIG. 6, compressed air from line 21 is connected to a chamber 74 of a marker member through a solenoid valve 73, with the valve 73 being controlled by the control box 5 by the line 24 for operation of the marker pen 72. The marker pen 72 has a container 77 which is prestressed by a spring 76, and is filled with a marker agent 26, such that the container 77 moves towards the workpiece 9. The marker pen 73 has a felt nib 78 in order to transfer the marker agent 26, which contains luminophor, to the workpiece 10 and hence forms the mark 17.

The sewing machine 1 of FIG. 1 operates in the following manner. First, when the circular workpiece 9 is inserted in the sewing machine 1, the presser foot 15 is raised. The solenoid valve 23 is actuated at substantially the same time the presser foot 15 is lowered, and hence the marker agent 26 is sprayed onto the workpiece 9 by the marker 16. The mark 17 of FIG. 3 is not evaluated by the sensor 18, which is disposed at the reference spacing A, during the sewing operation by a control operation in the control box 5 until it detects it for the second time. Thus, the circular workpiece is sewn round completely. The oversewing of the seam may be adjusted at the control panel 6 after a particular number of desired oversewn stitches have been sewn. If the sensor 18 is disposed in front of the marker 16 instead of behind the marker 16, the mark 17 may in this case be evaluated the first time it is detected.

Once the sewing threads have been severed and the presser foot 15 has been raised, the workpiece 9 may be removed from the sewing machine 1.

The sewing machine of FIG. 5 operates in the following cycle. The workpiece 10 is placed on the presser foot 15, and shortly before or during the start of the sewing operation the marker 16, which is disposed at a predetermined reference distance B, applies marking agent containing luminophor to the workpiece 10, with the marking agent being detected by the luminescence detector 68 as a mark 17 during the second run-through of the sewing operation, as described in conjunction with FIG. 1. The mark 17 is evaluated by a control operation in the control box 5, which, for example, can be used to send a signal to a termination means (e.g., a motor brake) to stop the sewing machine.

The foregoing detailed description is given for clearness of understanding only, and no unnecessary limitations should be understood therefrom, as modifications will be obvious to those skilled in the art.

What is claimed is:

1. A method of producing circular seams with overlapped ends on a workpiece using a sewing machine driven in a controlled manner, comprising the steps of:

applying a mark to the workpiece in the region of the seam;

sewing the workpiece detecting the mark using a sensor, sewing a particular number of oversewn stitches in response to detection of the mark, and terminating sewing operation.

2. The method of claim 1 wherein the applying step applies the mark as a marking agent.

3. The method of claim 2 wherein the marking agent applied to the workpiece comprises an agent which evaporates following effective detection by the sensor.

4. The method of claim 1 wherein the applying step comprises the step of pumping a marking agent from a supply source onto the workpiece.

5. The method of claim 1 wherein the applying step comprises the step of transferring a marker agent by a movable marker pen.

6. The method of claim 1 including the step of detecting the mark by a proximity switch.

7. The method of claim 2 wherein the marking agent comprises a luminophor to which the sensor responds.

8. The method of claim 2 wherein the marking agent is vaporizable.

9. A sewing machine, for producing circular seams with overlapped ends on a workpiece, having a marker for applying a mark to the workpiece, a sensor for sensing the mark, and a controller responsive to the sensor means for terminating operation of the sewing machine after a particular number of desired oversewn stitches have been sewn.

10. The sewing machine of claim 9 wherein the marker comprises a supply tank for a marking agent, and a pump for transferring the marking agent from the tank onto the workpiece.

11. The sewing machine of claim 9 wherein the marker comprises a movable marker pen for applying a marker agent onto the workpiece.

12. The sewing machine of claim 9 wherein the sensor comprises a proximity switch.

13. The sewing machine of claim 9 wherein the sensor comprises a luminescence detector for detecting a luminophor.

14. The sewing machine of claim 9 wherein the agent comprises a vaporizable marking agent such that the applied mark evaporates.

15. A sewing machine for performing an operation on a workpiece to form a circular seam, comprising:

marker means for applying a mark to the workpiece;

means for moving and sewing a circular seam in the workpiece;

means for sensing the mark;

means for indicating a selected number of stitches in a portion of the workpiece; and terminating means responsive to the sensing means for terminating operation of the sewing machine.

16. The sewing machine of claim 15 wherein the selected stitches are formed in an oversewn portion of the workpiece.

17. A sewing machine for performing an operation on a workpiece to form a circular seam, comprising:

means for applying a mark to the workpiece;

means for moving and sewing a seam in the workpiece;

means for sensing the mark;

means responsive to the sensing means for terminating operation of the sewing machine;

means for positioning the sensing means and applying means at a distance relative to each other, and means for adjusting said distance.

* * * * *